US009163630B2

(12) United States Patent
Hadar

(10) Patent No.: US 9,163,630 B2
(45) Date of Patent: Oct. 20, 2015

(54) INTEGRATED ELECTRIC VANE OIL PUMP

(75) Inventor: Gil Hadar, Guelph (CA)

(73) Assignee: Magna Powertrain Inc., Concord (CA)

( * ) Notice: Subject to any disclaimer, the term of this patent is extended or adjusted under 35 U.S.C. 154(b) by 892 days.

(21) Appl. No.: 13/203,524

(22) PCT Filed: Feb. 23, 2010

(86) PCT No.: PCT/CA2010/000268

§ 371 (c)(1),
(2), (4) Date: Nov. 7, 2011

(87) PCT Pub. No.: WO2010/096924

PCT Pub. Date: Sep. 2, 2010

(65) Prior Publication Data

US 2012/0051955 A1 Mar. 1, 2012

Related U.S. Application Data

(60) Provisional application No. 61/155,619, filed on Feb. 26, 2009.

(51) Int. Cl.

| | |
|---|---|
| ***F04C 14/22*** | (2006.01) |
| ***F04C 2/344*** | (2006.01) |
| ***F01C 21/08*** | (2006.01) |
| ***F04C 11/00*** | (2006.01) |

(52) U.S. Cl.

CPC ..... *F04C 2/3442* (2013.01); *F01C 21/0845* (2013.01); *F04C 11/008* (2013.01); *F04C 14/22* (2013.01)

(58) Field of Classification Search

CPC ..... F01C 1/32; F01C 1/328; F01C 1/336; F01C 1/3448

USPC ..... 417/410.4, 423.3, 423.14; 310/87; 418/61.3, 96, 132, 166, 171

See application file for complete search history.

(56) References Cited

U.S. PATENT DOCUMENTS

| | | | | |
|---|---|---|---|---|
| 5,190,447 | A | 3/1993 | Schneider | |
| 7,540,729 | B2 * | 6/2009 | Schneider | 418/173 |
| 8,545,200 | B2 * | 10/2013 | Watanabe et al. | 418/24 |
| 2003/0070879 | A1 | 4/2003 | Pringle et al. | |
| 2003/0107295 | A1 * | 6/2003 | Niimi et al. | 310/270 |
| 2006/0119189 | A1 * | 6/2006 | Fujinaga | 310/12 |
| 2009/0053075 | A1 * | 2/2009 | Cox | 417/53 |

FOREIGN PATENT DOCUMENTS

| | | |
|---|---|---|
| JP | 62-067286 | 3/1987 |
| JP | 2009-30536 | 2/2009 |

* cited by examiner

*Primary Examiner* — Charles Freay
*Assistant Examiner* — Patrick Hamo
(74) *Attorney, Agent, or Firm* — Harness, Dickey & Pierce, P.L.C.

(57) ABSTRACT

An electric vane pump includes a first cover plate having a substantially planar first pump surface and a second cover plate coupled to the first cover plate defining a substantially planar second pump surface spaced apart from and extending substantially parallel to the first pump surface. A plurality of permanent magnets are fixed to a rotor. A plurality of radially moveable vanes are fixed for rotation with the rotor. Each vane is positioned between the first and second pump surfaces and has a first end slidably engaging the center vane support. An electric motor stator is positioned between the first and second cover plates and circumscribes the rotor. A resilient member biases each of the vanes into engagement with the center vane support.

23 Claims, 9 Drawing Sheets

INTEGRATED ELECTRIC VANE OIL PUMP

CROSS-REFERENCE TO RELATED APPLICATIONS

This application claims the benefit of U.S. Provisional Application No. 61/155,619, filed on Feb. 26, 2009. The entire disclosure of the above application is incorporated herein by reference.

FIELD

The present disclosure generally relates to an electric motor driven pump. More particularly, a submersible integrated electric vane oil pump is described.

BACKGROUND

This section provides background information related to the present disclosure which is not necessarily prior art.

A number of electric pumps have been disclosed combining an electric motor and a vane pump. For example, U.S. Patent No. 6,499,964 describes an electric motor and a vane pump that are usable separately or in combination with one another. While this concept may provide the desired pumping function, redundancies exist, possibly negatively affecting the cost, size and weight of the fluid pump.

In addition, U.S. Pat. No. 4,407,641 describes an electrically driven vane pump. The rotor of the electric motor and the rotor of the vane pump are integrated with each other. However, the disclosed pump arrangement includes multiple casings and occupies a relatively large volume of space. Accordingly, a need in the art exists for an improved integrated electric vane oil pump.

SUMMARY

This section provides a general summary of the disclosure, and is not a comprehensive disclosure of its full scope or all of its features.

An electric vane pump includes a first cover plate having a substantially planar first pump surface and a second cover plate coupled to the first cover plate defining a substantially planar second pump surface spaced apart from and extending substantially parallel to the first pump surface. A plurality of permanent magnets are fixed to a rotor. A plurality of radially moveable vanes are fixed for rotation with the rotor. Each vane is positioned between the first and second pump surfaces and has a first end slidably engaging a center vane support. An electric motor stator is positioned between the first and second cover plates and circumscribes the rotor. A resilient member biases each of the vanes into engagement with the center vane support.

In another arrangement, an electric vane pump includes first and second shells having substantially planar first and second pump surfaces, respectively. The first and second pump surfaces are spaced apart from and extend substantially parallel to one another. The electric vane pump also includes a center vane support, a rotor and a plurality of radially moveable vanes fixed for rotation with the rotor. Each vane is positioned between the first and second pump surfaces and has an end slidably engaging the center vane support. A shaft including spaced apart shoulders engages each of the first and second shells to define a predetermined spacing between the first and second pump surfaces. An electric motor stator is positioned between the first and second shells. A plurality of permanent magnets are fixed for rotation with the rotor and positioned proximate the stator.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
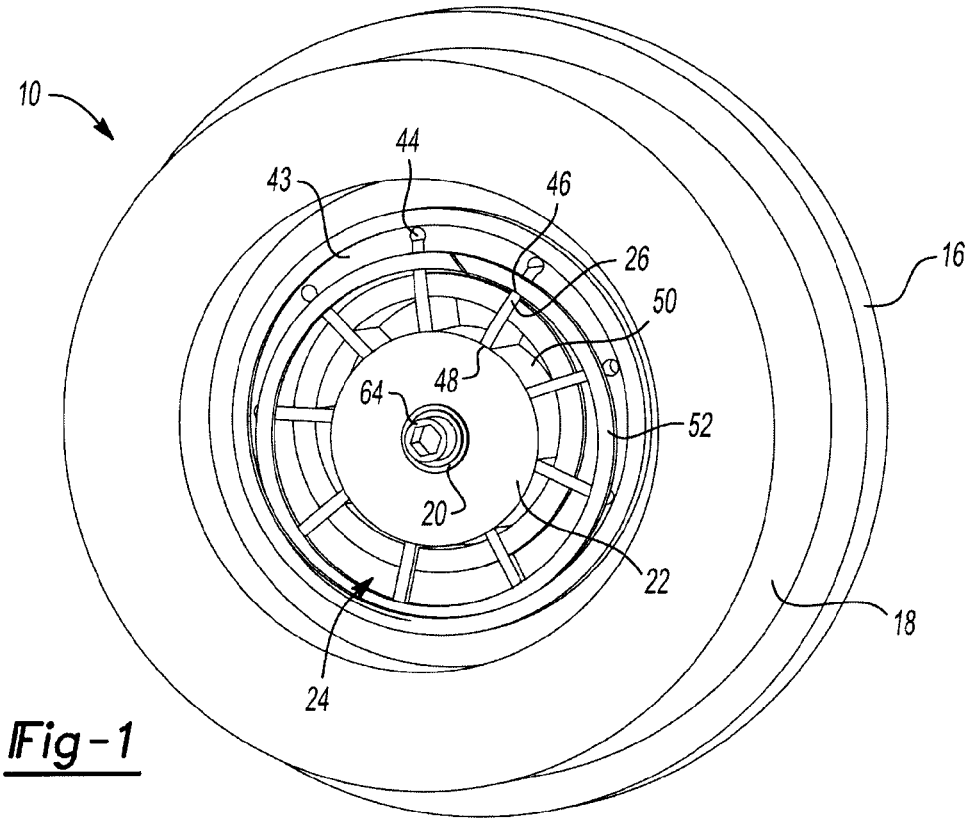
FIG. 1 is a perspective view of an electric vane pump constructed in accordance with the teachings of the present disclosure.
Figure 2:
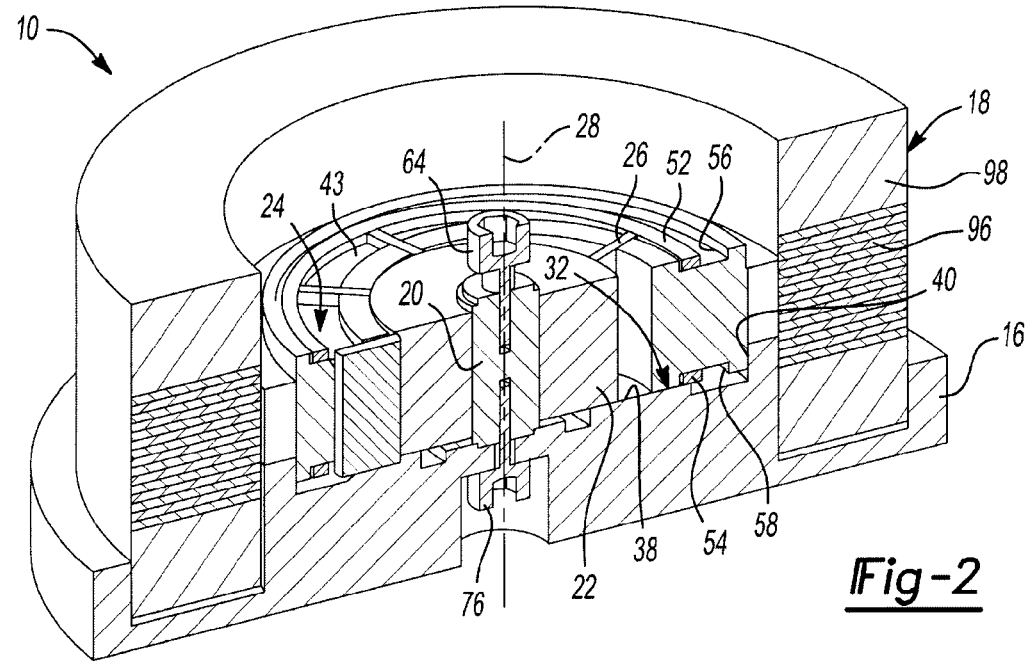
FIG. 2 is a fragmentary perspective view of the electric vane pump.
Figure 3:
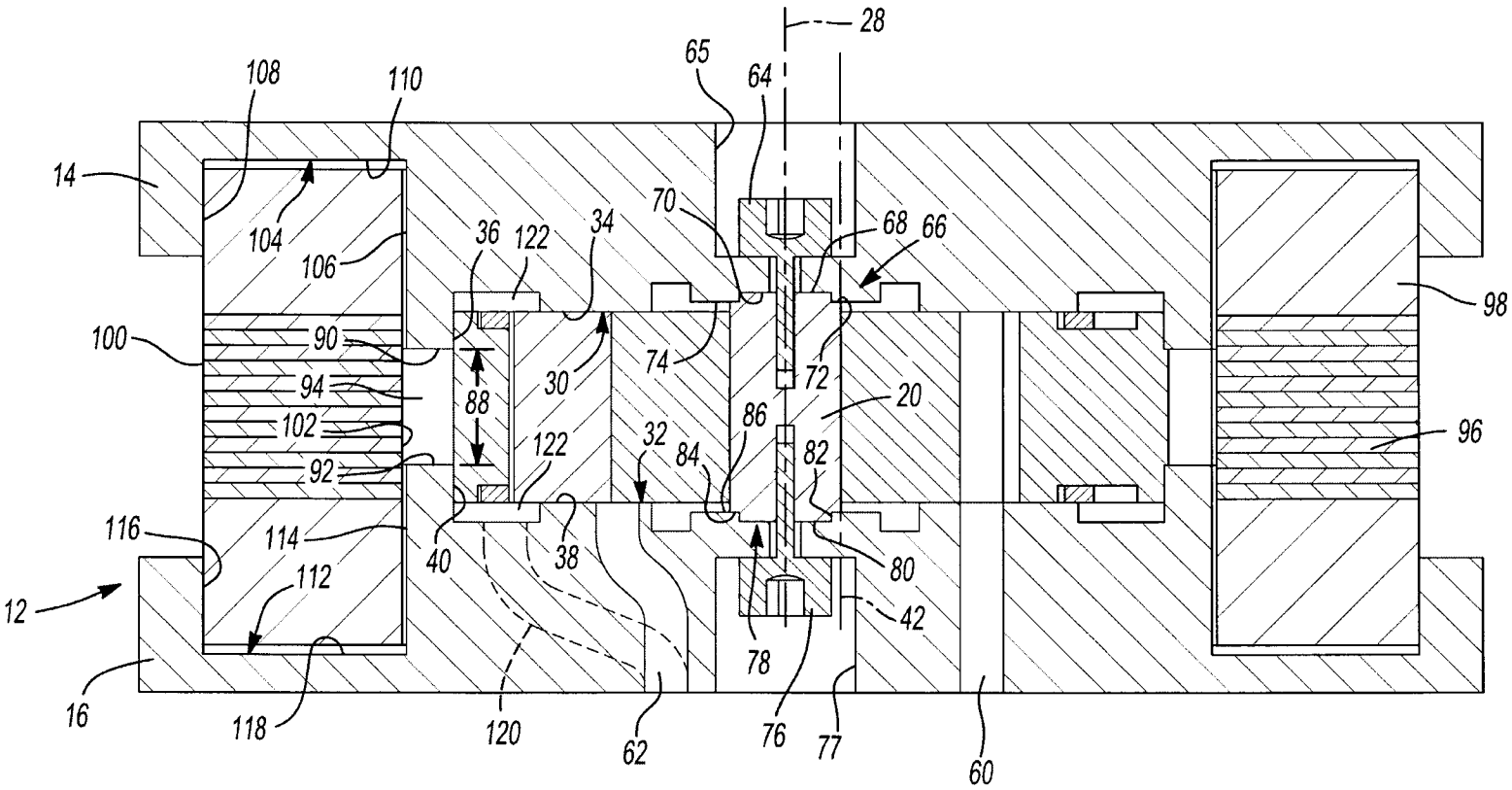
FIG. 3 is a cross-sectional view of the electric vane pump.
Figure 4:
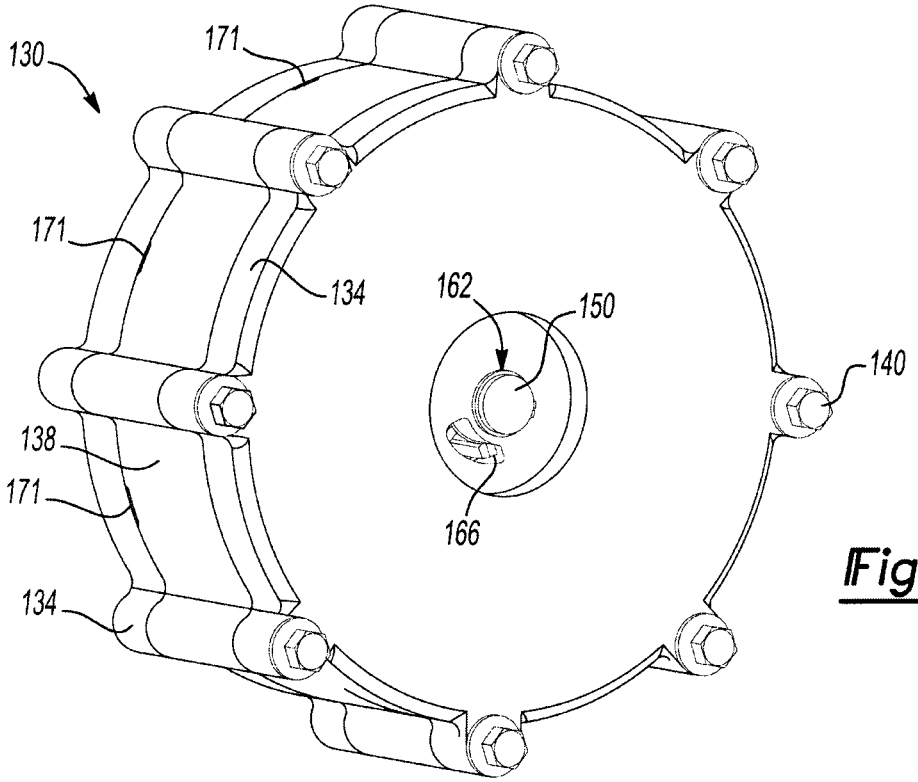
FIG. 4 is a perspective view of an alternate electric vane pump.
Figure 5:
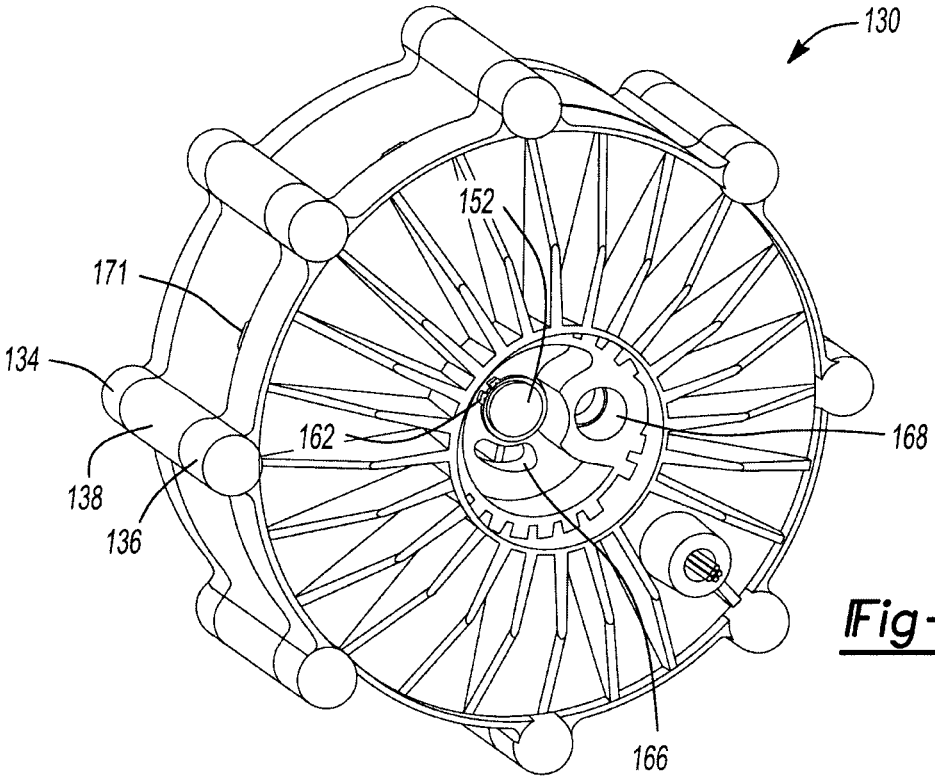
FIG. 5 is another perspective of the alternate electric vane pump.
Figure 6:
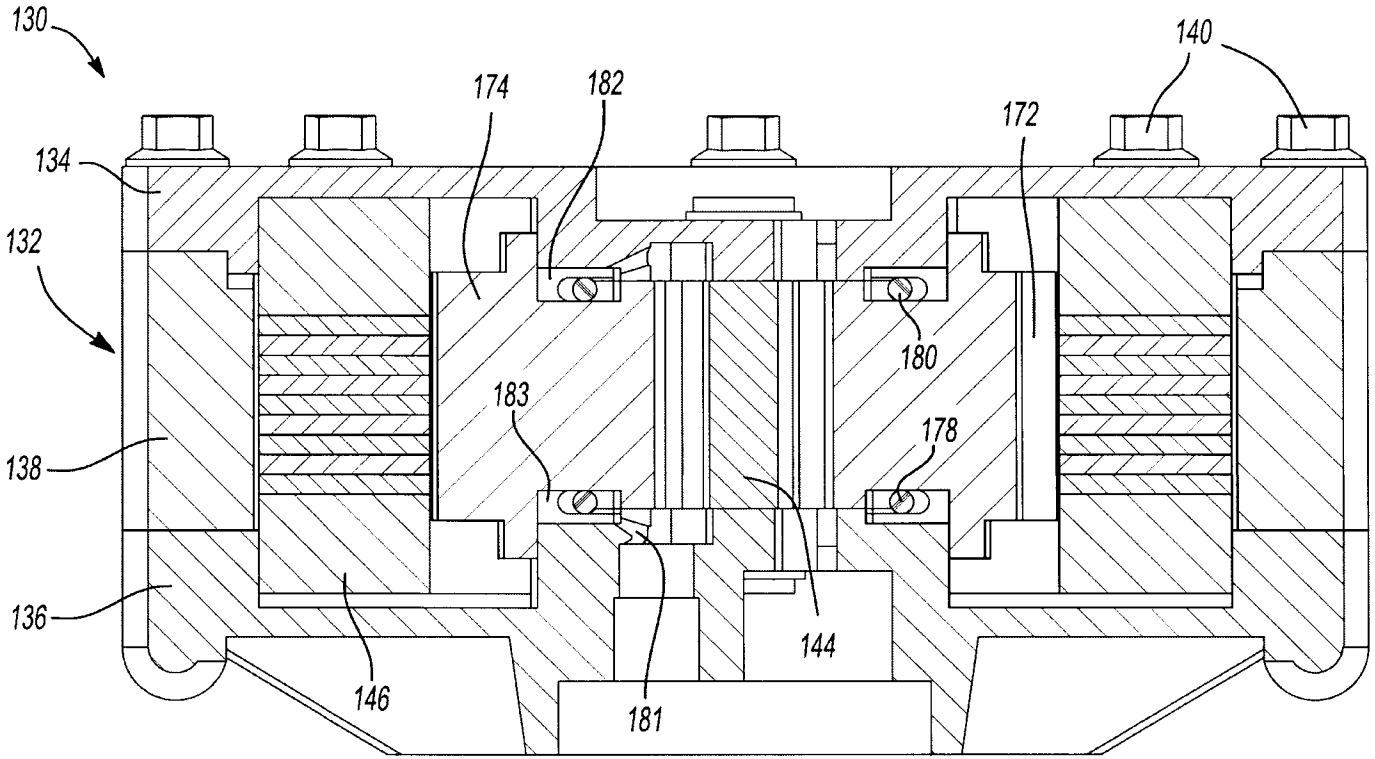
FIG. 6 is a cross-sectional view of the alternate electric vane pump.
Figure 7:
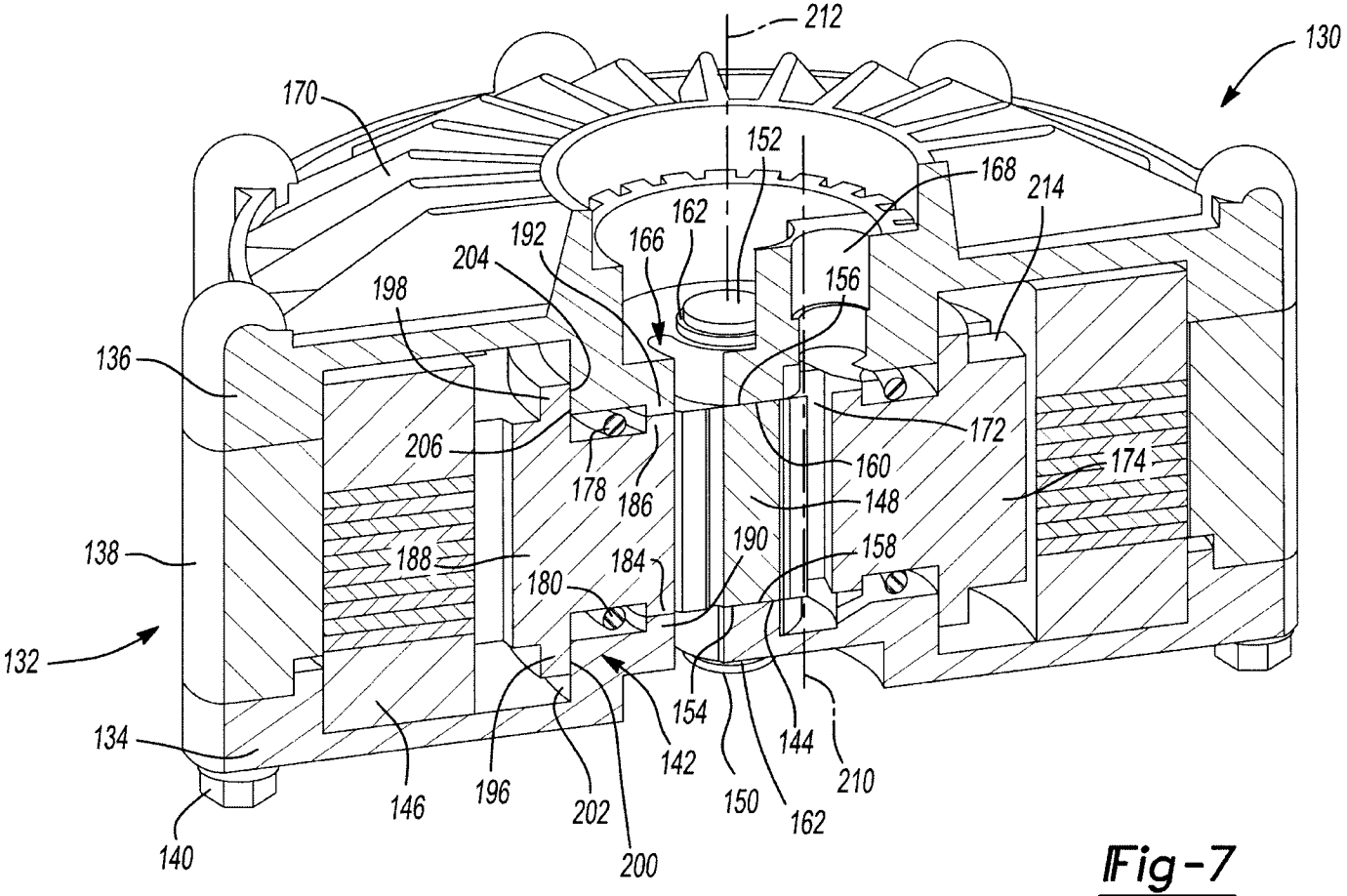
FIG. 7 is a fragmentary perspective view of the alternate electric vane pump depicted in FIGS. 4-6.

FIGS. 1-3 depict an integrated electric vane oil pump identified at reference numeral 10. Pump 10 includes a housing 12 having a first shell 14 and a second shell 16. Each of first shell 14 and second shell 16 may be formed as aluminum die castings. A stator 18 is sandwiched between first shell 14 and second shell 16. First shell 14, second shell 16 and stator 18 are fixed to one another along the perimeter of pump 10. Any number of fastening methods may be employed including screwing, crimping, clamping, riveting, welding, adhesive bonding or the like.

Electric vane oil pump 10 includes a shaft 20, a center vane support 22, a rotor assembly 24 and a plurality of vanes 26 in cooperation with one another to define a vane pump. Shaft 20 is a substantially cylindrically shaped member having a longitudinal axis 28. Rotor assembly 24 is supported for rotation within recesses 30, 32 formed within first shell 14 and second shell 16, respectively. Recess 30 is at least partially defined by a substantially planar first pump surface 34 and a circumferentially extending wall 36. In similar fashion, recess 32 is defined by a second pump surface 38 and a circumferentially extending wall 40. Walls 36 and 40 are aligned with one another along an axis of rotation 42 about which rotor assembly 24 rotates.

Rotor assembly 24 includes a rotor 43 including plurality of radially extending blind slots 44 each in receipt of a radially moveable vane 26. Slots 44 are configured to fix vanes 26 for rotation with rotor 43 while allowing each vane 26 to independently radially move during rotation of rotor assembly 24. Each vane 26 includes a first end 46 positioned within one of slots 44 and a second opposite end 48 in contact with a substantially cylindrical outer surface 50 of center vane support 22. A pair of resilient retaining clips 52, 54 are positioned within circumferential grooves 56, 58 formed on opposite sides of rotor 43. Each retaining clip 52, 54 is a split ring sized to engage first ends 46 of vanes 26 to maintain second ends 48 in contact with surface 50. Due to the eccentric arrangement between center vane support 22 and rotor assembly 24, pump 10 is operable to draw fluid from a low pressure reservoir through an inlet port 60 while pressurized fluid exits pump 10 at an outlet port 62. Inlet port 60 extends through second shell 16. Outlet port 62 also extends through second shell 16.

A first fastener 64 extends through a counterbore 65 form in first shell 14 to fix a first end 66 of shaft 20 to first shell 14. A reduced diameter portion 68 is formed at first end 66 and placed in communication with a first recess 70 formed in first shell 14 to accurately position shaft 20. First fastener 64 draws a first shoulder 72 of shaft 20 into contact with an offset face 74 formed on first shell 14.

In similar fashion, a second fastener 76 extends through a counterbore 77 formed in second shell 16 to fix a second end 78 of shaft 20 to second shell 16. A stepped reduced diameter portion 80 is accurately positioned within a recess 82 formed in second shell 16. A second shoulder 84 is secured against an offset face 86 formed on second shell 16. The distance between first shoulder 72 and second shoulder 84 is accurately controlled to define a running clearance between rotor assembly 24, first shell 14 and second shell 16. Furthermore, fasteners 64, 76 restrict first shell 14 and second shell 16 from moving away from rotor assembly 24 while fluid forces are generated during pumping. Proper pump function is thereby maintained.

Shaft 20 also defines a gap 88 between an end face 90 of first shell 14 and an end face 92 of second shell 16. A plurality of magnets 94 are fixed for rotation with rotor 43. Magnets 94 are arranged in alternating polarity about the circumference of rotor 43 and positioned within gap 88.

Stator 18 includes a plurality of plates 96 encompassed by windings 98. Stator 18 includes an outer cylindrical surface 100 and an inner cylindrical surface 102. First shell 14 includes a pocket 104 in receipt of a portion of stator 18. Pocket 104 is defined by an inner cylindrical wall 106, an outer cylindrical wall 108 and an end wall 110 interconnecting wall 106 and wall 108. Outer cylindrical wall 108 is sized to closely fit outer cylindrical surface 100 of stator 18. A gap exists between stator 18 and inner cylindrical wall 106 as well as between end wall 110 and stator 18. A flexible sealing compound or adhesive may be used to fill the gaps and couple stator 18 to first shell 14 while allowing relative movement therebetween. Second shell 16 includes a similar pocket 112 defined by an inner cylindrical wall 114, an outer cylindrical wall 116 and an end wall 118. The fit between the various surfaces of stator 18 and second shell 16 are similar to those previously described with relation to first shell 14.

Magnets 94 are positioned in close proximity to but clear of first shell 14, second shell 16 and inner cylindrical surface 102 of stator 18. It should be appreciated that the windings 98 of stator 18 need not be positioned within a protective case and, therefore, may be positioned in very close proximity to magnets 94. It should be appreciated that the efficiency of the electric motor increases as the gap between magnets 94 and windings 98 is decreased. To maximize motor efficiency, it is contemplated that the distance between permanent magnets 94 and a current carrying portion of stator 18 ranges from about 0.5 mm to 0.8 mm. Furthermore, windings 98 may be placed in direct contact with a fluid to be pumped if pump 10 is fully submerged. This arrangement increases heat transfer away from stator 18 by contact with the fluid. Pump 10 is also operable in a partially submerged or in a non-submerged mode as well.

Pump 10 may be optionally equipped with a high pressure passage 120 interconnecting outlet port 62 and pressure chambers 122, 124 formed in first shell 14 and second shell 16, respectively. During pump operation, pressurized fluid flows from outlet port 62 through passage 120 to pressure chambers 122, 124 to apply a force on first ends 46 of vanes 26. The pressurized fluid further drives second ends 48 of vanes 26 into contact with outer surface 50. The forces applied by the pressurized fluid and retaining clips 52, 54 counteract fluid pressure and centripetal acceleration forces attempting to move vanes 26 radially outwardly.

In operation, current is passed through windings 98 to generate a magnetic field. Permanent magnets 94 are urged to move thereby causing rotor 43 to rotate. As vanes 26 rotate, fluid pumping occurs. As pumping continues, first fastener 64 and second fastener 76 restrict first shell 14 and second shell 16 from spacing apart from one another and changing the distance between first pump surface 34 and second pump surface 38. Furthermore, retaining clips 52, 54 maintain a biased engagement between vanes 26 and surface 50 to assure proper pump function at various pump speeds.

FIGS. 4-8 depict an alternate pump identified at reference numeral 130. Pump 130 is also an integrated electric vane oil pump that may be fully submersible within a fluid to be pumped. Integrated electric vane oil pump 130 includes a housing 132 having a first cover plate 134, a second cover plate 136 and an intermediate ring 138. Each of the first and second cover plates 134, 136 may be formed as aluminum die castings. Intermediate ring 138 is sandwiched between first cover plate 134 and second cover plate 136 to compensate for the coefficient of thermal expansion of housing 132 possibly being different than the components within housing 132. To accomplish this goal, intermediate ring 138 is preferably constructed from a material having a coefficient of thermal expansion substantially less than that of aluminum. For example, intermediate ring 138 may be constructed from a powdered metal material. First cover plate 134, second cover plate 136 and intermediate ring 138 are fixed to one another along the perimeter of pump 130 by a plurality of fasteners 140. It should be appreciated that any number of other fastening methods may be employed including crimping, clamping, riveting, welding, adhesive bonding or the like.

Pump 130 includes a rotor assembly 142 acting in cooperation with an integral, monolithic, shaft and center vane support 144. A stator 146 surrounds rotor assembly 142. Combination shaft and center vane support 144 includes a substantially cylindrical body 148 having axially aligned first and second trunnions 150, 152. At the intersection between body 148 and first trunnion 150 is a first seat 154. A second seat 156 is formed at the intersection between body 148 and second trunnion 152. Seats 154, 156 engage a first pump face 158 formed on first cover plate 134 and a second pump face 160 formed on second cover plate 136, respectively. Each of trunnions 150, 152 includes a groove in receipt of a retaining ring 162. Retaining rings 162 restrict first cover plate 134 from moving relative to second cover plate 136 during pump operation.

An inlet 166 is formed in second cover plate 136 to allow low pressure fluid to be drawn into communication with rotor assembly 142. An outlet 168 is also formed in second cover plate 136 for providing a passageway for pressurized fluid exiting pump 130. A plurality of fins 170 are integrally formed on second cover plate 136 for transferring heat from pump 130 to the fluid to be pumped. A plurality of radially extending vents 171 are formed within intermediate ring 138 to allow fluid to pass through housing 132 into communication with stator 146 to further assist in transferring heat from pump 130 to the surrounding fluid.

Rotor assembly 142 includes a plurality of vanes 172 fixed for rotation with but radially moveable relative to a rotor 174. One end of vanes 172 is in contact with a substantially cylindrical outer surface of body 148. First and second elastomeric members 178, 180 circumscribe the opposite ends of vanes 172 to biasedly engage the vanes with combination shaft and center vane support 144. Elastomeric members 178, 180, may be constructed as o-rings having circular cross sections. Other geometrical shapes may also be used. A high pressure passage 181 interconnects outlet 168 with a first cavity 182 formed between rotor 174 and first cover plate 134 as well as a second cavity 183 formed between rotor 174 and second cover plate 136. Pressurized fluid within cavities 182, 183 urges vanes 172 toward body 148.

Rotor 174 includes an inner pair of flanges 184, 186 axially extending from opposite ends of a body portion 188. First cover plate 134 and second cover plate 136 also include corresponding axially extending flanges 190, 192 for limiting axial translation of rotor 174. Rotor 174 also includes first and second outer flanges 196, 198. First outer flange 196 includes an inner cylindrical surface 200 overlapping an outer cylindrical surface 202 formed on first cover plate 134. Similarly, a second cylindrical inner surface 204 of second outer flange 198 is positioned adjacent to an outer cylindrical surface 206 formed on second cover plate 136. Outer cylindrical surfaces 206 and 202 are aligned with one another along an axis 210.

Due to the arrangement previously discussed, rotor 174 is guided to rotate about axis 210. Body 148 defines a longitudinal axis 212 extending substantially parallel to and offset from axis 210. As previously discussed, this eccentric arrangement provides the pumping action when rotor assembly 142 is rotated. Rotor assembly 142 also includes a plurality of permanent magnets 214 spaced apart from one another in alternating polarity about the circumference of rotor 174. Permanent magnets 214 are placed in close proximity to stator 146.

Figure 8:
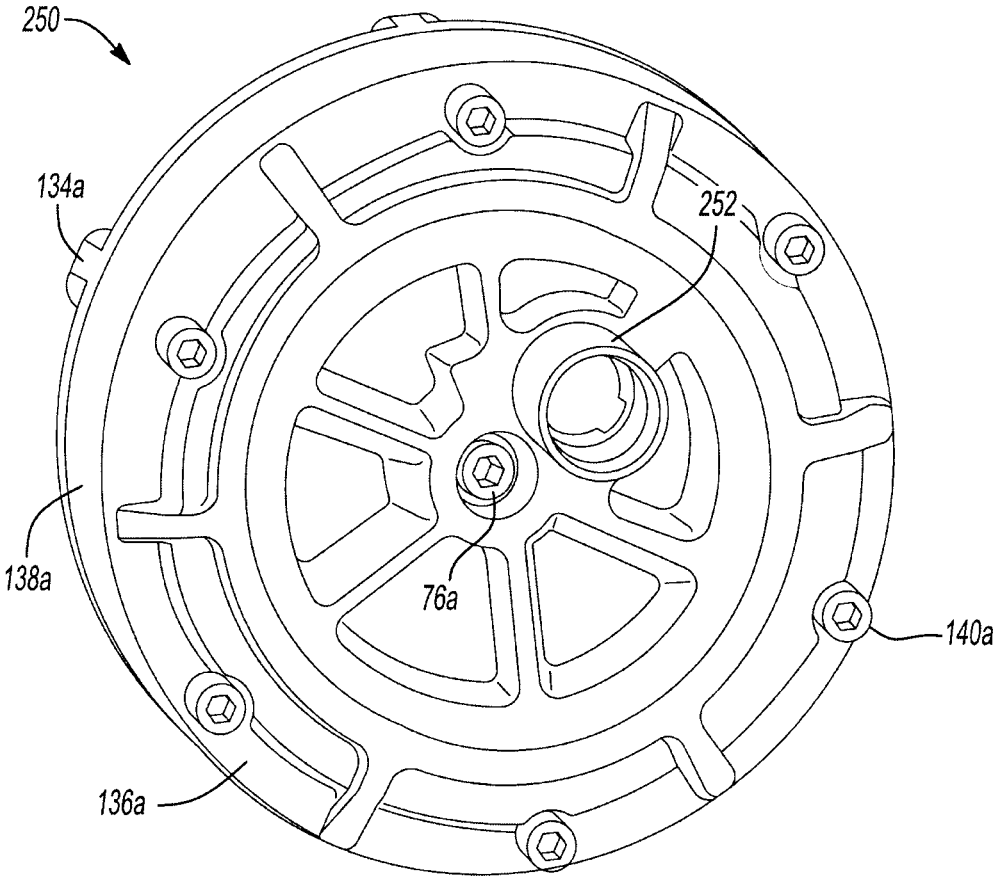
FIG. 8 is a perspective view of another alternate electric vane pump.
Figure 9:
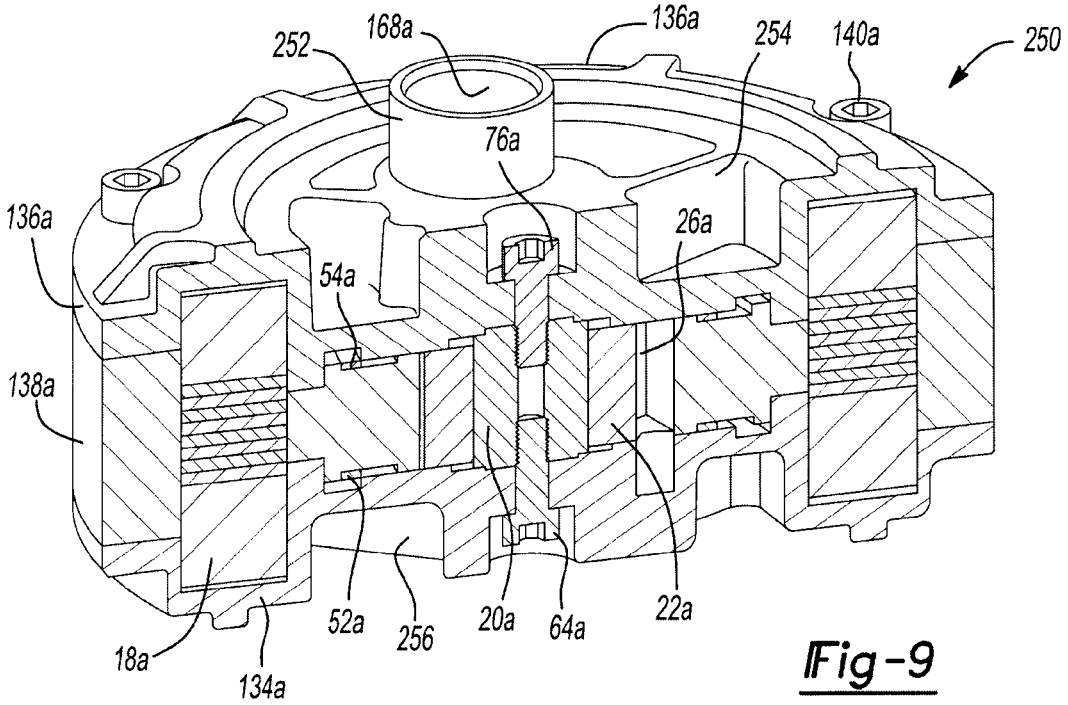
FIG. 9 is a fragmentary perspective view of the electric vane pump depicted in FIG. 8.
Figure 10:
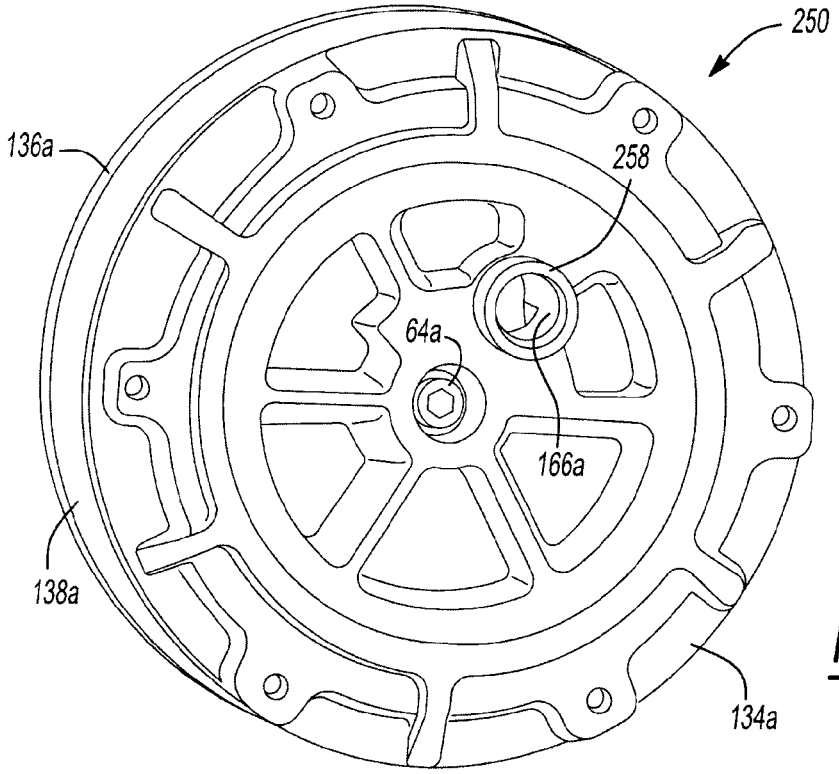
FIG. 10 is another perspective view of the pump depicted in FIGS. 8 and 9.

FIGS. 8-10 depict another alternate integrated electric vane oil pump identified at reference numeral 250. Pump 250 is substantially similar to pumps 10 and 130 previously described. Accordingly, similar elements will be identified with like reference numerals including an "a" suffix. In particular, pump 250 combines the housing features of pump 130, now identified as first cover plate 134*a*, second cover plate 136*a* and intermediate ring 138*a* with the internal pump features of pump 10, now depicted as stator 18*a*, rotor assembly 24*a*, shaft 20*a*, center vane support 22*a* and fasteners 64*a* and 76*a*. It should be appreciated that while pump 250 is shown to be equipped with retaining clips 52*a*, 54*a*, elastomeric members 178, 180 may be used in their place in either pump 250 or pump 10. Similarly, the dual fastener arrangement 64, 76 and 64*a*, 76*a* may be replaced with a pin and retaining ring arrangement as used by pump 130.

Pump 250 includes second cover plate 136*a* having an axially extending boss 252 defining outlet 168*a*. A plurality of pockets 254 are also formed in second cover plate 136*a* to reduce the weight of pump 250. Similar pockets 256 are formed within first cover plate 134*a*. Another boss 258 is formed on first cover plate 134*a* and defines inlet 166*a*.

Figure 11:
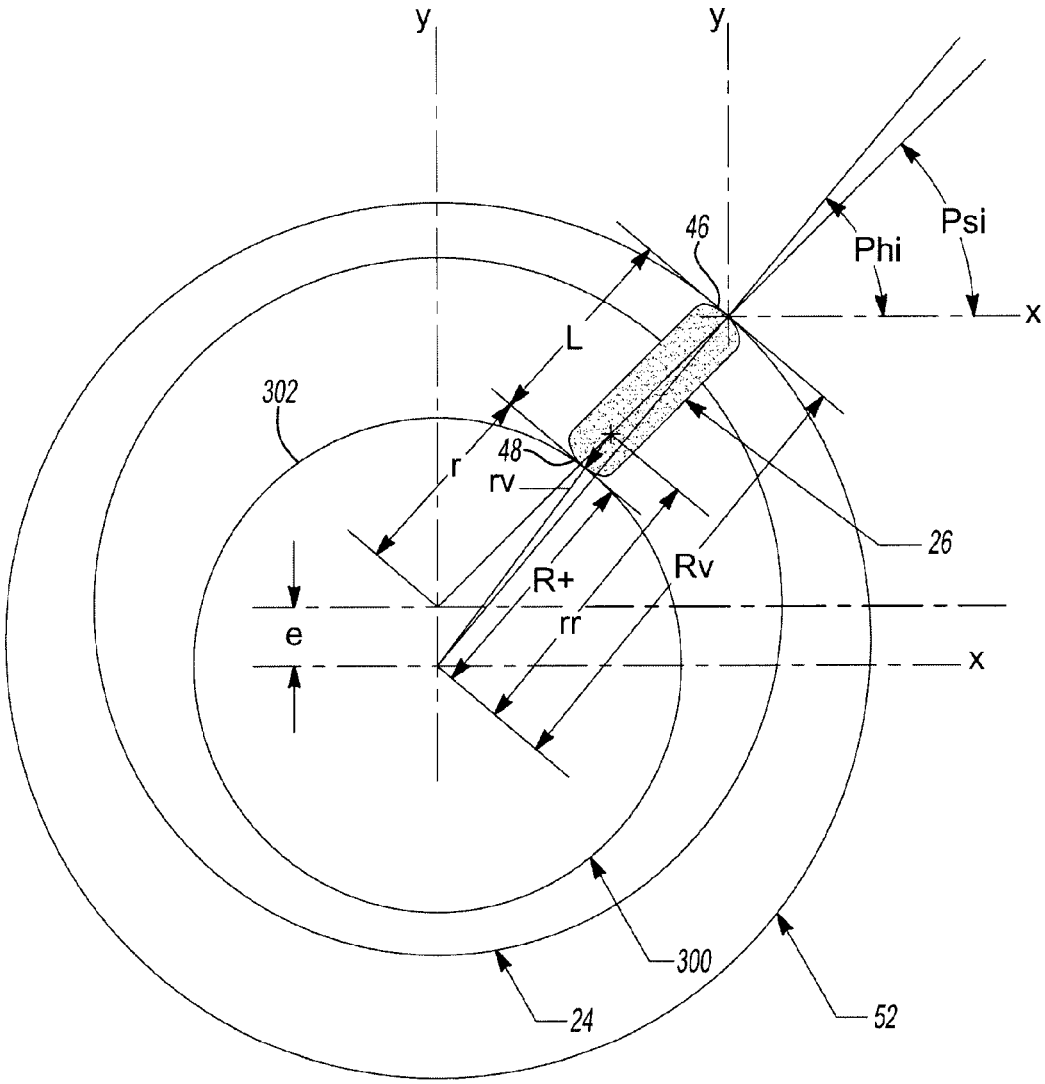
FIGS. 11 and 12 depict a schematic for generating an alternate center vane support surface.
Figure 12:
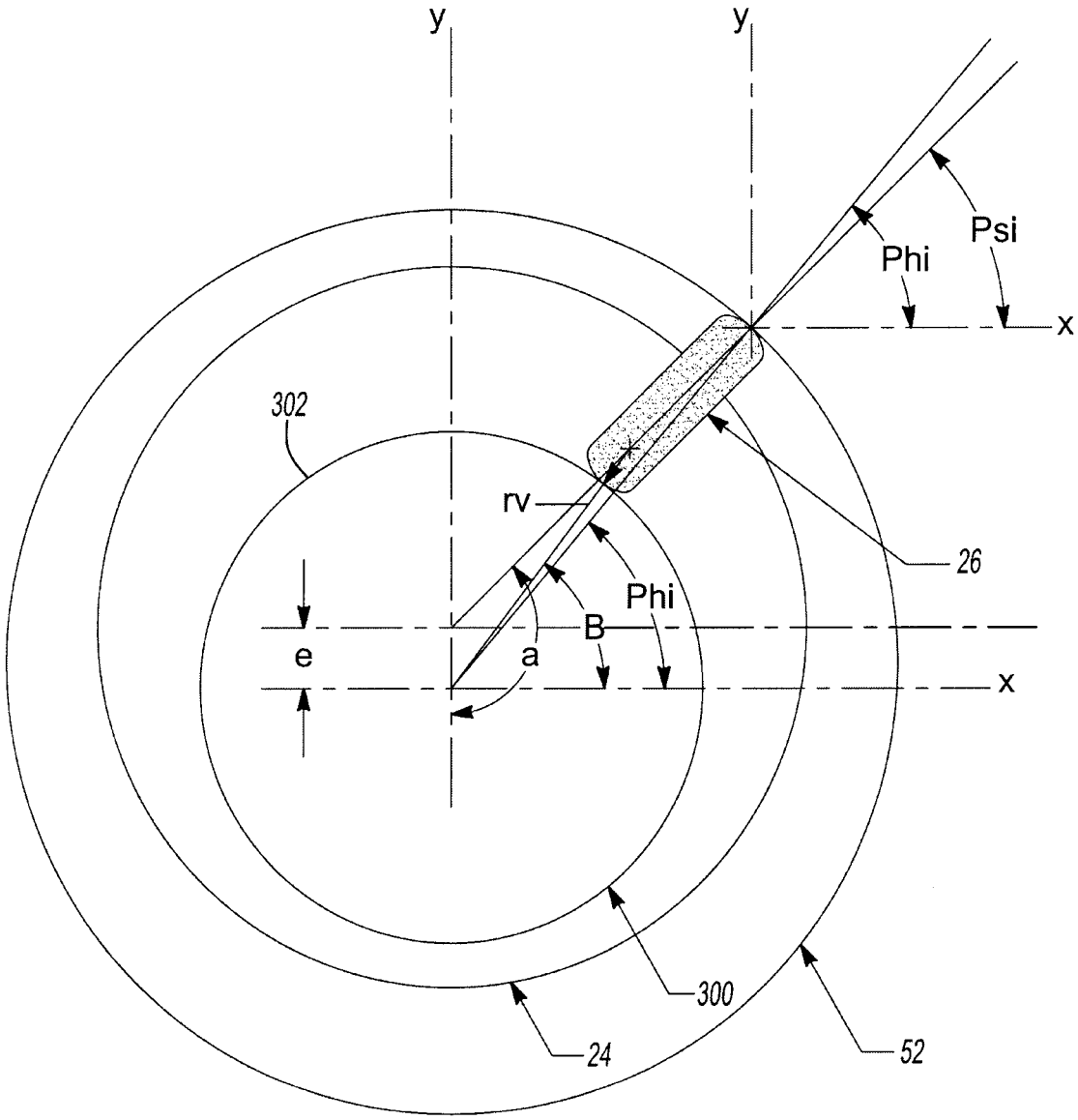

FIGS. 11 and 12 depict a center vane support 300 having an outer surface 302 defined by a special profile to minimize gaps between vanes 26 and center vane support 300. It should be appreciated that each of the embodiments previously described may be modified to include the special profile depicted in FIGS. 11 and 12, if desired. As such, the outer surface of center vane support 22 or the outer surface of shaft and center vane support 144 may be manufactured to no longer define a circular cylindrical surface but include the shape of surface 302. Through the use of shaped surface 302, first end 46 of each vane 26 radially translates less during operation than when a circular cylindrically shaped vane contact surface is formed on the center vane support. Accordingly, elastomeric elements such as retaining clips 52, 54 do not need to account for relatively large differences in the radial position of first ends 46 of vanes 26. A more consistent contact pressure between second end 48 of each vane 26 and profile 302 may result. The shape of profile 302 is defined by the following equations such that the equations may be solved to plot profile 302 as (R', B).

Equations:

$$(r+L)^2 = [e^2 + Rv^2 - 2*Rv*e*\cos(90 - Phi)] \tag{1}$$

$$r = [e^2 + Rv^2 - 2*Rv*e*\cos(90 - Phi)]^{0.5} - L$$

$$\cos(psi) = \frac{[Rv*\sin(Phi)]}{R+L}$$

$$\sin(psi) = \frac{[Rv*\sin(Phi) - e]}{R+L}$$

$$psi = \tan^{-1}\frac{[Rv*\sin(Phi) - e]}{[Rv*\cos(Phi)]} \tag{2}$$

$$a = \frac{pi}{2} + psi \tag{3}$$

$$rr^2 = [r^2 + e^2 - 2*r*e*\cos(a)]$$

$$rr = [r^2 + e^2 - 2*r*e*\cos(a)]^{0.5} \tag{4}$$

$$B = \tan^{-1}\frac{[r*\sin(psi) + e]}{[r*\cos(psi)]} \tag{5}$$

$$R' = rr - rv \tag{6}$$

where:

r=slide center to rotor OD

L=vane length e=eccentricity

Rv=vane ring ID radius

Phi=angle of vane ID radius relative to rotor center

Psi=angle of vane relative to slide center a=angle from eccentricity line to r+L line B=angle relative to rotor center to rr line rr=calculated rotor profile relative to rotor center and extending to vane radius center point rv=vane radius R'=corrected rotor profile relative to rotor center considering the vane radius (i.e. inner offset of profile by rv)

pi=constant=3.14

To assure proper pump operation, the component including profile 302 is rotated to a predetermined position relative to line y passing through the center of rotor 24 and the center of center vane support 300. Any number of mechanical devices including a dowel, a key or some other asymmetric feature may be incorporated to assure proper orientation of profile 302.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An electric vane pump comprising:

a first shell having a substantially planar first pump surface;

a second shell coupled to the first shell and having a substantially planar second pump surface spaced apart from and extending substantially parallel to the first pump surface;

a center vane support;

a rotor;

a plurality of radially moveable vanes fixed for rotation with the rotor, each vane being positioned between the first and second pump surfaces and having an end slidably engaging the center vane support;

a shaft including spaced apart shoulders engaging each of the first and second shells to define a predetermined spacing between the first and second pump surfaces;

an electric motor stator positioned between the first and second shells; and a plurality of permanent magnets fixed for rotation with the rotor, the magnets being positioned proximate the stator.

2. The electric vane pump of claim 1 wherein a first end of the shaft is fixed to the first shell and a second end of the shaft is fixed to the second shell to resist forces generated during pumping from increasing the predetermined spacing between the first and second pump surfaces.

3. The electric vane pump of claim 2 further including a threaded fastener extending through an aperture in the first shell threadingly engaging the shaft.

4. The electric vane pump of claim 2 further including a retaining ring secured to a portion of the shaft extending through one of the first and second shells.

5. The electric vane pump of claim 1 wherein the rotor includes a convex cylindrical surface supported for rotation within a pocket formed in one of the first and second shells.

6. The electric vane pump of claim 1 wherein the stator includes a wire winding in contact with a fluid to be pumped.

7. The electric vane pump of claim 1 wherein the first and second pump surfaces, the vanes, and the center vane support at least partially define fluid pumping chambers.

8. The electric vane pump of claim 1 wherein a distance between the permanent magnets and a current carrying member of the stator ranges from 0.5 to 0.8 mm.

9. The electric vane pump of claim 1 further including a resilient member biasing each of the vanes in engagement with the center vane support.

10. The electric vane pump of claim 1 further including an intermediate ring sandwiched between end surfaces of each of the first and second shells, the ring having a lower coefficient of thermal expansion than either of the first and second shells.

11. The electric vane pump of claim 1 wherein the rotor rotates about an axis extending substantially parallel to a longitudinal axis defined by the center vane support.

12. The electric vane pump of claim 1 wherein the shaft and the center vane support are formed as a single monolithic member.

13. The electric vane pump of claim 1 wherein each vane engages a non-circular profile formed on the center vane support to minimize radial translation of the vanes during pump operation.

14. The electric vane pump of claim 1, wherein the predetermined spacing between the first and second pump surfaces provides clearance for the vanes and rotor to rotate adjacent to the first and second pump surfaces.

15. An electric vane pump comprising:

a first cover plate having a substantially planar first pump surface;

a second cover plate coupled to the first cover plate and defining a substantially planar second pump surface spaced apart from and extending substantially parallel to the first pump surface;

a center vane support, a rotor, a plurality of permanent magnets fixed to the rotor and a plurality of radially moveable vanes fixed for rotation with the rotor, each vane being positioned between the first and second pump surfaces and having a first end slidably engaging the center vane support, wherein the first and second pump surfaces and the vanes at least partially define fluid pumping chambers;

an electric motor stator positioned between the first and second cover plates and circumscribing the rotor; and a resilient member biasing each of the vanes into engagement with the center vane support.

16. The electric vane pump of claim 15 wherein one of the first and second cover plates includes a passageway interconnecting an outlet of the vane pump with a chamber containing the vanes, wherein pressurized fluid from the outlet passes through the passageway and applies a force urging each of the vanes toward the center vane support.

17. The electric vane pump of claim 15 further including a threaded fastener extending through an aperture in one of the first and second cover plates threadingly engaging the center vane support.

18. The electric vane pump of claim 15 wherein the rotor includes a convex cylindrical surface supported for rotation within a pocket formed in one of the first and second cover plates.

19. The electric vane pump of claim 15 wherein the rotor includes a concave cylindrical surface supported for rotation by a convex cylindrical surface formed on one of the first and second cover plates.

20. The electric vane pump of claim 15 wherein the stator includes a wire winding in contact with a fluid to be pumped.

21. The electric vane pump of claim 15 further including an intermediate ring sandwiched between each of the first and second cover plates, the ring having a lower coefficient of thermal expansion than either of the first and second cover plates.

22. The electric vane pump of claim 15 wherein the rotor includes opposite end faces, each end face including a groove in receipt of one of the resilient member and another resilient member for biasedly engaging each vane into contact with the center vane support.

23. The electric vane pump of claim 15 wherein each vane engages a non-circular profile formed on the center vane support to minimize radial translation of the vanes during pump operation.

* * * * *